US008523710B2

(12) United States Patent
Isogawa et al.

(10) Patent No.: US 8,523,710 B2
(45) Date of Patent: Sep. 3, 2013

(54) GOLF BALL

(75) Inventors: Kazuhiko Isogawa, Kobe (JP); Tsutomu Hirau, Kobe (JP)

(73) Assignee: SRI Sports Limited, Kobe (JP)

( * ) Notice: Subject to any disclaimer, the term of this patent is extended or adjusted under 35 U.S.C. 154(b) by 18 days.

(21) Appl. No.: 12/974,683

(22) Filed: Dec. 21, 2010

(65) Prior Publication Data

US 2011/0111888 A1 May 12, 2011

Related U.S. Application Data

(63) Continuation of application No. 12/219,506, filed on Jul. 23, 2008.

(30) Foreign Application Priority Data

Aug. 21, 2007 (JP) ..... 2007-214224

(51) Int. Cl.
*A63B 37/06* (2006.01)

(52) U.S. Cl.
USPC ..... 473/378

(58) Field of Classification Search
USPC ..... 473/378
See application file for complete search history.

(56) References Cited

U.S. PATENT DOCUMENTS

| | | | | |
|---|---|---|---|---|
| 5,713,802 | A * | 2/1998 | Moriyama et al. | 473/374 |
| 6,558,277 | B1 | 5/2003 | Ohira et al. | |
| 6,824,479 | B2 | 11/2004 | Isogawa et al. | |
| 7,976,412 | B2 * | 7/2011 | Isogawa et al. | 473/378 |
| 2009/0111614 | A1 | 4/2009 | Ohira | |

FOREIGN PATENT DOCUMENTS

| | | | |
|---|---|---|---|
| GB | 2 341 867 | A | 11/1999 |
| JP | 6-170013 | A | 6/1994 |
| JP | 10-298458 | A | 11/1998 |
| JP | 11-140346 | A | 5/1999 |
| JP | 2000-254251 | A | 9/2000 |
| JP | 2001-3001 | * | 1/2001 |
| JP | 2001-003001 | A | 1/2001 |
| JP | 2002-275421 | A | 9/2002 |
| JP | 2004-166719 | A | 6/2004 |
| JP | 2007-070424 | A | 3/2007 |

* cited by examiner

*Primary Examiner* — Raeann Gorden
(74) *Attorney, Agent, or Firm* — Birch, Stewart, Kolasch & Birch, LLP

(57) ABSTRACT

Golf ball 2 has spherical core 4, cover 6 positioned outside the core 4, mark layer 8 and paint layer 10. The resin composition of the cover 6 includes composite particles. The composite particle has a nucleus and a coat layer. The nucleus is constituted with aluminum oxide. The coat layer is constituted with titanium oxide. The composite particles are flaky. The amount of the composite particles is 0.1 parts by weight or more and 15 parts by weight or less per 100 parts by weight of the base resin of the cover 6. The composite particles may be also dispersed in the paint layer 10. The amount of the composite particles in the paint layer 10 is 1 part by weight or more and 30 parts by weight or less per 100 parts by weight of the base resin of the paint layer 10.

3 Claims, 3 Drawing Sheets

GOLF BALL

This application is a Continuation Application of pending U.S. application Ser. No. 12/219,506 filed Jul. 23, 2008, which claims priority to Japanese Patent Application No. 2007-214224 filed on Aug. 21, 2007. The entire contents of all of the above applications are hereby incorporated by reference in their entirety.

BACKGROUND OF THE INVENTION

1. Field of the Invention

The present invention relates to golf balls.

2. Description of the Related Art

Golf balls have marks printed thereon. The mark includes brand name, and ball number. Golf players can distinguish their ball from other's ball by the brand. The golf players can distinguish their ball from other's ball also by the ball number. The golf players get close to the ball, and distinguish it based on such marks. It is difficult to distinguish the ball based on the mark from a distance.

Golf balls have a core and a cover. General golf balls are mostly white colored. The coloring has been achieved by dispersing a pigment in the cover. The coloring may be also achieved by painting the surface of the cover.

The golf ball may be colored blue, red or the like. These golf balls are referred to as "color ball". In the color balls, a large amount of a pigment is dispersed in the cover or the paint layer. The color balls can be easily distinguished from the white balls. However, the color balls are inferior in high-grade looking. Many golf players avoid selection of the color balls.

There also exist golf balls in which metal powders are dispersed in the cover. The metal powders impart luminance to the golf ball. The metal powders contribute to distinguishability. However, the metal powders deteriorate lightness of the golf ball. The golf balls in which the metal powders are used are inferior in high-grade looking.

Japanese Unexamined Patent Application Publication No. Hei 6-170013 discloses a golf ball including composite particles in the cover or the paint layer. These composite particles include mica, and titanium oxide coating this mica. This golf ball has luminance. An appearance of this golf ball exhibits a polarization property. This golf ball can be distinguished from common golf balls.

Japanese Unexamined Patent Application Publication No. 2000-254251 discloses a golf ball in which a pigment containing a liquid crystal polymer is dispersed in the paint layer. This pigment contributes to the polarization property. This golf ball has a unique appearance. This golf ball can be distinguished from common golf balls.

Japanese Unexamined Patent Application Publication No. 2004-166719 discloses a golf ball in which the paint layer includes glass flakes. This golf ball is excellent in the luminance. This golf ball can be distinguished from common golf balls.

Mica is a natural mineral, and includes a large amount of impurities. These impurities may deteriorate the chroma saturation of the golf ball. Since mica is translucent, mica is accompanied by less masking ability. Therefore, satisfactory luminance is not exhibited. Furthermore, disruption is likely to occur in kneading since mica is inferior in the strength. The disruption will deteriorate the polarization property. The golf ball disclosed in Japanese Unexamined Patent Application Publication No. Hei 6-170013 is inferior in high-grade looking.

The color of a pigment containing a liquid crystal polymer is changed significantly as it is used. In addition, the color change becomes remarkable resulting from the polarization property of the pigment. The golf ball disclosed in Japanese Unexamined Patent Application Publication No. 2000-254251 is inferior in the weather resistance.

Particles of the glass flakes have a large size. When a paint containing the glass flakes is coated, the glass flakes may deteriorate the smoothness of the paint layer. This paint layer is inferior in the appearance. Furthermore, the glass flakes may compromise the durability of the paint layer. The golf ball disclosed in Japanese Unexamined Patent Application Publication No. 2004-166719 is inferior in the high-grade looking and durability of the paint layer.

An object of the present invention is to provide a golf ball that is excellent in distinguishability, high-grade looking, weather resistance, and durability of the paint layer.

SUMMARY OF THE INVENTION

The golf ball according to the present invention has a core, a cover provided so as to cover this core, and a paint layer provided so as to cover this cover. This cover or paint layer includes composite particles having a nucleus, and a coat layer provided so as to coat this nucleus. The nucleus is constituted with a metal oxide. The coat layer contains titanium oxide.

Preferably, the nucleus is constituted with aluminum oxide. Preferably, the composite particles are flaky.

When the cover constituted with a resin composition includes the composite particles, preferable amount of the composite particles is 0.1 parts by weight or more and 15 parts by weight or less per 100 parts by weight of a base resin of the resin composition.

When the paint layer constituted with a resin composition includes the composite particles, preferable amount of the composite particles is 1 part by weight or more and 30 parts by weight or less per 100 parts by weight of a base resin of the resin composition.

According to this golf ball, the reflected light on the nucleus interferes with the reflected light on the coat layer. Due to this interference, luminance is imparted to the golf ball. This luminance serves in exhibiting distinguishability and high-grade looking. Since the nucleus is constituted with a metal oxide, this golf ball is excellent in weather resistance. Even though the composite particles are used in the paint layer, these composite particles do not compromise durability of the paint layer.

DESCRIPTION OF THE PREFERRED EMBODIMENTS

Hereinafter, the present invention will be described in detail according to the preferred embodiments with appropriate references to the accompanying drawing.

Figure 1:
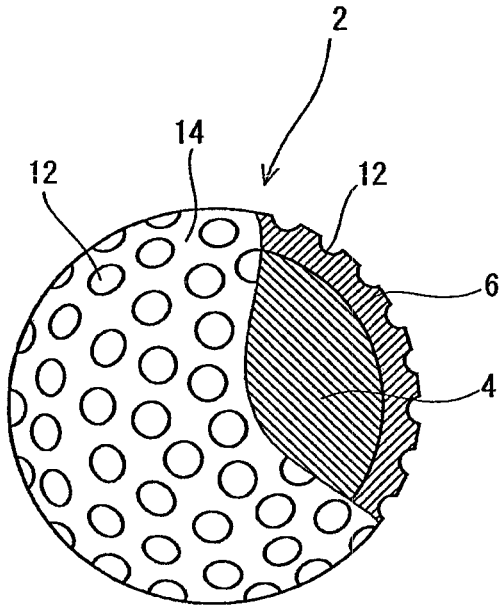
FIG. 1 shows a cross-sectional view illustrating a part of a golf ball according to one embodiment of the present invention.
Figure 2:
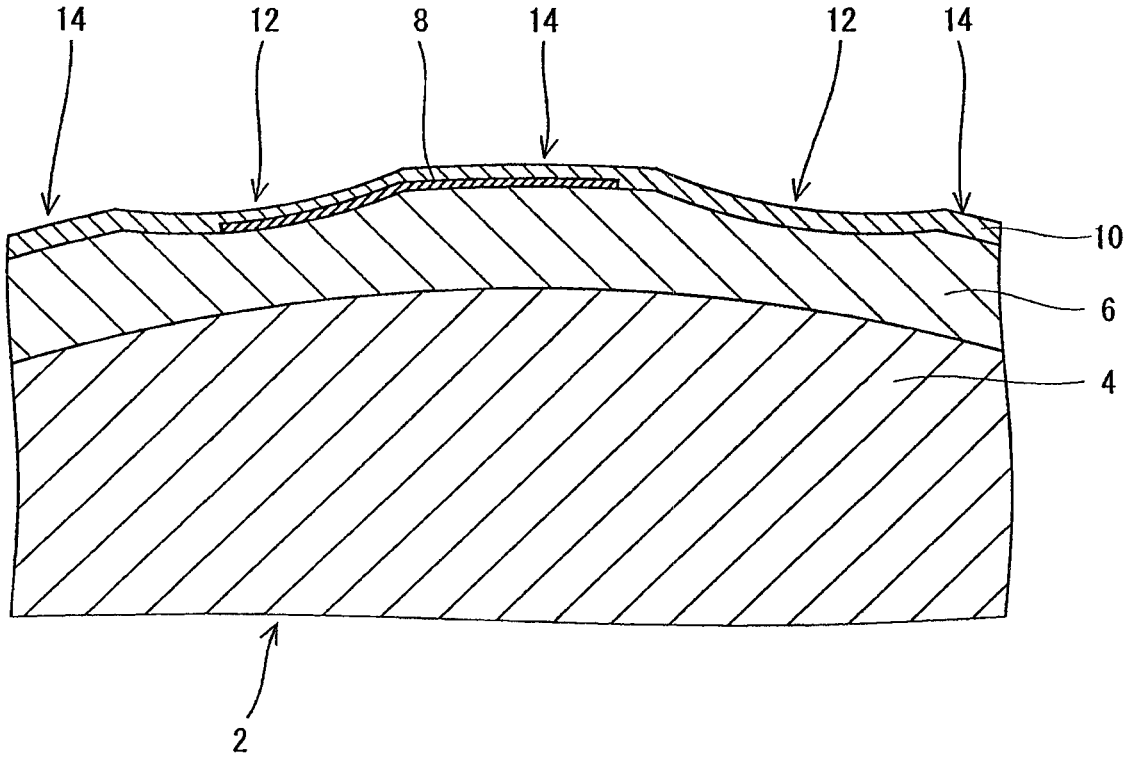
FIG. 2 shows an enlarged cross-sectional view illustrating a part of the golf ball shown in FIG. 1.

Golf ball 2 illustrated in FIG. 1 has spherical core 4, cover 6 positioned outside this core 4, mark layer 8 and paint layer 10. This golf ball 2 has dimples 12 and land 14 on the surface thereof. The mark layer 8 and the paint layer 10 are not shown in FIG. 1. The golf ball 2 may also have other paint layer between the cover 6 and the mark layer 8.

The core 4 is formed by crosslinking a rubber composition. Illustrative examples of the base rubber for use in the rubber composition include polybutadienes, polyisoprenes, styrene-butadiene copolymers, ethylene-propylene-diene copolymers and natural rubbers. For the crosslinking, a co-crosslinking agent is preferably used. Preferably, the rubber composition includes an organic peroxide. The core 4 may be composed of two or more layers.

The cover 6 is constituted with a resin composition. A thermoplastic resin or a thermosetting resin can be used for the cover 6. Typical resin may be an ionomer resin and polyurethane. The cover 6 may include a styrene elastomer, a polyamide elastomer, a polyester elastomer and a polyolefin elastomer.

A white colorant is added to the cover 6. Typical white colorant may be titanium dioxide. The cover 6 having a desired color may be obtained by using titanium dioxide in combination with other pigment. The amount of titanium dioxide is preferably 0.1 parts by weight or more and 5 parts by weight or less per 100 parts by weight of the base resin.

Figure 3:
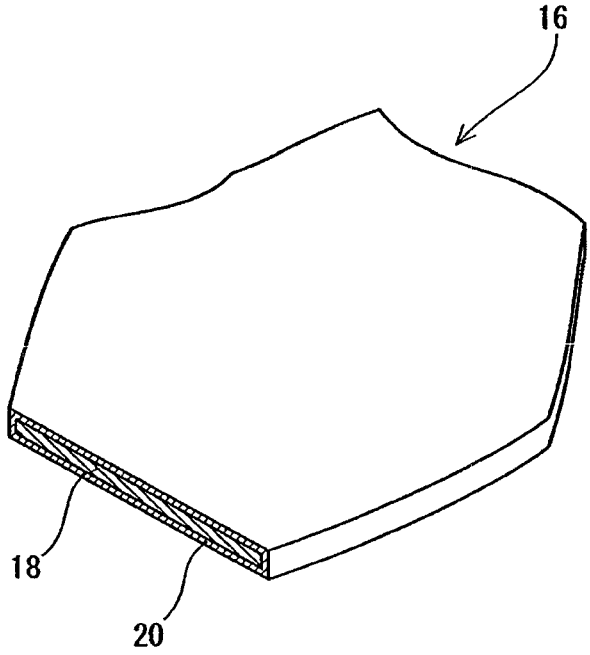
FIG. 3 shows a cross-sectional perspective view illustrating a composite particle blended in the golf ball shown in FIG. 1.

The resin composition of the cover 6 includes composite particles. FIG. 3 shows a cross-sectional perspective view illustrating the composite particle 16. This composite particle 16 includes nucleus 18, and coat layer 20. The nucleus 18 is constituted with a metal oxide. The coat layer 20 is constituted with titanium oxide. A part of the light ray entered into the cover 6 is reflected on the coat layer 20. A part of the light ray entered into the cover 6 passes through the coat layer 20, and is reflected on the nucleus 18. The reflected light on the coat layer 20 interferes with the reflected light on the nucleus 18. This interference imparts luminance to the golf ball 2. The appearance of the golf ball 2 having the luminance is different from the appearance of conventional golf balls. This golf ball 2 is excellent in distinguishability. In addition, the golf ball 2 having the luminance is excellent in high-grade looking.

As shown in FIG. 3, the composite particles 16 are flaky. The flaky composite particles 16 are accompanied by directionality in the interferential action. The composite particle 16 has varying colors depending on the angle of view. A polarization property is imparted to the golf ball 2 by dispersing the flaky composite particles 16. This polarization property achieves the distinguishability and the high-grade looking of the golf ball 2.

The composite particle 16 in which the nucleus 18 is constituted with the metal oxide is less likely to subject to color change. This composite particle 16 does not compromise the weather resistance of the golf ball 2. Since the metal oxide is excellent in strength, the composite particle 16 does not compromise the durability of the paint layer 10. The composite particle 16 in which the nucleus 18 is constituted with the metal oxide is less likely to subject to disruption in kneading the resin composition. Suppression of the disruption imparts a sufficient polarization property to the golf ball 2. Moreover, since the metal oxide has high masking ability, this composite particle 16 improves the distinguishability.

Illustrative example of preferable metal oxide for the nucleus 18 may be aluminum oxide ($Al_2O_3$). The aluminum oxide imparts more satisfactory luminance as compared with the case in which aluminum is used. The aluminum oxide serves in achieving the high-grade looking of the golf ball 2. Additionally, the aluminum oxide is excellent in strength.

The coat layer 20 constituted with titanium oxide contributes to the luminance of the golf ball 2. Typically, titanium dioxide is used in the coat layer 20. The coat layer 20 may also include a small amount of a pigment. When the coat layer 20 includes a material other than titanium oxide, the proportion of titanium oxide in the coat layer 20 may be equal to or greater than 90% by weight, and further, equal to or greater than 95% by weight. The coat layer 20 has a thickness of preferably 0.1 μm or greater and 10 μm or less.

The composite particles 16 have a particle size of preferably 5 μm or greater and 50 μm or less. The composite particles 16 having a particle size of equal to or greater than 5 μm can achieve the luminance and the polarization property. In this respect, the particle size is more preferably equal to or greater than 10 μm. By using the composite particles 16 having a particle size of equal to or less than 50 μm, weld line of the cover 6 is less likely to be remarkable. In this respect, the particle size is more preferably equal to or less than 30 μm. The particle size is a number average value measured by Laser Scattering Particle Size Distribution Analyzer "LA-910", available from Horiba, Ltd.

The amount of the composite particle 16 is preferably 0.1 parts by weight or more and 15 parts by weight or less per 100 parts by weight of the base resin of the cover 6. Excellent luminance is exhibited by dispersing 0.1 parts by weight or more composite particles 16 in the cover 6. In this respect, the amount is more preferably equal to or greater than 0.3 parts by weight, and particularly preferably equal to or greater than 0.5 parts by weight. According to the cover 6 including 15 parts by weight or less composite particles 16, the high-grade looking is achieved by high lightness. In this respect, the amount is more preferably equal to or less than 10 parts by weight, and particularly preferably equal to or less than 5 parts by weight.

Into the cover 6 may be blended a filler such as barium sulfate, an antioxidant, an ultraviolet absorbent, a light stabilizer, a fluorescent agent, a fluorescent brightening agent and the like in an appropriate amount as needed. The cover 6 has a thickness of 0.1 mm or greater and 3.5 mm or less.

The mark layer 8 is constituted with an ink composition. This ink composition includes a base resin and a pigment. Illustrative examples of the base resin specifically include epoxy resins, polyester polyol, polyether polyol, polyurethane polyol and nitrocellulose. The mark layer 8 has a color that is different from the color of the cover 6. The mark layer 8 displays manufacturer's name, brand name, ball number and the like.

The mark layer 8 is formed by printing on the surface of the cover 6. Pad printing, engraving printing, ink jet printing, transfer film printing or the like can be employed. In light of productivity, pad printing is preferred.

The paint layer 10 covers the cover 6 or the mark layer 8. The mark layer 8 is protected by the paint layer 10. The paint layer 10 is formed by coating a paint. Electrostatic coating, spray gun coating, brush coating or the like can be employed. Illustrative examples of the base resin for the paint include polyurethane, epoxy resins, polyester, acrylic resins, cellulose resins and the like. In light of durability of the paint layer 10, two-component cured polyurethane is preferred.

The two-component cured polyurethane is obtained by a reaction of a base material and a curing agent. The two-component cured polyurethane prepared by a reaction of a base material containing a polyol component with a curing agent containing polyisocyanate (including a polyisocyanate derivative) is preferred.

It is preferred that urethane polyol be used as the polyol component of the base material. The urethane polyol has urethane bonds and at least two hydroxyl groups. Preferably, the urethane polyol has a hydroxyl group at its end. The urethane polyol may be obtained by allowing polyol and polyisocyanate to react at a ratio by which an excess molar ratio of the hydroxyl group of the polyol component to the isocyanate group of polyisocyanate is attained.

The polyol for use in production of the urethane polyol has multiple hydroxyl groups. Polyol having a weight average molecular weight of 50 or greater and 2,000 or less, and particularly 100 or greater and 1,000 or less is preferred. Examples of the polyol having a low molecular weight include diol and triol. Specific examples of the diol include ethylene glycol, diethylene glycol, triethylene glycol, 1,3-butanediol, 1,4-butanediol, neopentyl glycol and 1,6-hexanediol. Specific examples of the triol include glycerin, trimethylolpropane and hexanetriol. Examples of the polyol having a high molecular weight include polyether polyols such as polyoxyethylene glycol (PEG), polyoxypropylene glycol (PPG) and polyoxytetramethylene glycol (PTMG); condensed polyester polyols such as polyethylene adipate (PEA), polybutylene adipate (PBA) and polyhexamethylene adipate (PHMA); lactone based polyester polyols such as poly-□-caprolactone (PCL); polycarbonate polyols such as polyhexamethylene carbonate; and acrylic polyols. Two or more kinds of the polyol may be used in combination.

Polyisocyanate for use in production of urethane polyol has multiple isocyanate groups. Specific examples of the polyisocyanate include aromatic polyisocyanates such as 2,4-toluene diisocyanate, 2,6-toluene diisocyanate, mixtures of 2,4-toluene diisocyanate and 2,6-toluene diisocyanate (TDI), 4,4'-diphenylmethane diisocyanate (MDI), 1,5-naphthylene diisocyanate (NDI), 3,3'-bitolylene-4,4'-diisocyanate (TODI), xylylene diisocyanate (XDI), tetramethylxylylene diisocyanate (TMXDI) and paraphenylene diisocyanate (PPDI); alicyclic polyisocyanates such as 4,4'-dicyclohexylmethane diisocyanate ($H_{12}$MDI), hydrogenated xylylene diisocyanate ($H_6$XDI) and isophorone diisocyanate (IPDI); and aliphatic polyisocyanates such as hexamethylene diisocyanate (HDI). Two or more polyisocyanates may be used in combination. In light of the weather resistance, TMXDI, XDI, HDI, $H_6$XDI, IPDI and $H_{12}$MDI are preferred.

In the reaction of polyol and polyisocyanate for producing the urethane polyol, any known catalyst can be used. Typical catalyst may be dibutyltin dilaurate.

The ratio of the urethane bonds included in the urethane polyol is preferably 0.1 mmol/g or greater and 5 mmol/g or less. The urethane polyol having this ratio of equal to or greater than 0.1 mmol/g can serve in achieving the scuff resistance of the paint layer 10. The urethane polyol having this ratio of equal to or less than 5 mmol/g can serve in achieving the following capability of the paint layer 10 with the cover 6. The paint layer 10 that is excellent in the following capability is less likely to be cracked in repeated hitting of the golf ball 2. The ratio of the urethane bonds may be adjusted to fall within the above range by regulating the molecular weight of the polyol to be the raw material. The ratio of the urethane bonds may be adjusted to fall within the above range also by regulating compounding ratio of the polyol and the polyisocyanate.

In light of a short time period required for the reaction of the base material with the curing agent, the urethane polyol has a weight average molecular weight of preferably equal to or greater than 4,000, and more preferably equal to or greater than 4,500. In light of the adhesiveness between the paint layer 10 and the cover 6, the weight average molecular weight is preferably equal to or less than 10,000, and more preferably equal to or less than 9,000.

In light of the adhesiveness between the paint layer 10 and the cover 6, the urethane polyol has a hydroxyl value (mg KOH/g) of preferably equal to or greater than 15, and more preferably equal to or greater than 73. In light of a short time period required for the reaction of the base material with the curing agent and inhibition of cracking, the hydroxyl value is preferably equal to or less than 130, and more preferably equal to or less than 120.

The base material may contain, in addition to the urethane polyol, a polyol not having any urethane bond. The aforementioned polyol that is the raw material of the urethane polyol may be used in the base material. Polyols that are miscible with the urethane polyol are preferred. In light of a short time period required for the reaction of the base material with the curing agent, the proportion of the urethane polyol in the base material is preferably equal to or greater than 50% by weight, and more preferably equal to or greater than 80% by weight based on the solid content. Ideally, this proportion is 100% by weight.

The curing agent contains polyisocyanate or a derivative thereof. The aforementioned polyisocyanate that is the raw material of the urethane polyol may be used in the curing agent.

The paint for the paint layer 10 includes the composite particles 16. The composite particles 16 are dispersed in the paint layer 10. Those similar to the composite particles 16 included in the cover 6 may be used in the paint layer 10. The luminance and the polarization property can be imparted to the golf ball 2 by means of the composite particles 16 in the paint layer 10. In this embodiment, the composite particles 16 are blended in both the cover 6 and the paint layer 10. The composite particles 16 may be blended in only the cover 6. Alternatively, the composite particles 16 may be blended in only the paint layer 10.

Also in the paint layer 10, the composite particles 16 have a particle size of preferably 5 μm or greater and 50 μm or less. The composite particles 16 having a particle size of equal to or greater than 5 μm can achieve the luminance and the polarization property. In this respect, the particle size is more preferably equal to or greater than 10 μm. The composite particles 16 having a particle size of equal to or less than 50 μm can achieve the smoothness of the paint layer 10. In this respect, the particle size is more preferably equal to or less than 30 μm.

The amount of the composite particle 16 in the paint layer 10 is preferably 1 part by weight or more and 30 parts by weight or less per 100 parts by weight of the base resin of the paint layer 10. Excellent luminance is exhibited by dispersing 1 part by weight or more composite particles 16 in the paint layer 10. In this respect, the amount is more preferably equal to or greater than 3 parts by weight, and particularly preferably equal to or greater than 5 parts by weight. According to the paint layer 10 including 30 parts by weight or less composite particles 16, the high-grade looking is achieved by high lightness. Furthermore, according to the paint layer 10 including 30 parts by weight or less composite particles 16, the durability of the paint layer 10 is not compromised by the composite particles 16. In this respect, the amount is more preferably equal to or less than 20 parts by weight, and particularly preferably equal to or less than 15 parts by weight.

Into the paint may be blended additives such as an antioxidant, an ultraviolet absorbent, a light stabilizer, a fluorescent agent, a fluorescent brightening agent and the like in an appropriate amount as needed. The paint layer 10 has a thickness of 3 μm or greater and 100 μm or less. Other paint layer may be provided on the external side of the paint layer 10.

EXAMPLES

Example 1

A rubber composition was obtained by kneading 100 parts by weight of polybutadiene (trade name "BR-730", available from JSR Corporation), 25 parts by weight of zinc diacrylate, 10 parts by weight of zinc oxide, 15 parts by weight of barium sulfate, 0.5 parts by weight of diphenyl disulfide (Sumitomo Seika Chemicals Co., Ltd.) and 0.8 parts by weight of dicumyl peroxide (NOF Corporation). This rubber composition was placed into a mold having upper and lower mold half each having a hemispherical cavity, and heated at 170° C. for 20 minutes to obtain a core having a diameter of 38.9 mm.

45 parts by weight of an ionomer resin neutralized with sodium (trade name "Surlyn® 8945" available from Du Pont Kabushiki Kaisha), 45 parts by weight of an ionomer resin neutralized with zinc (trade name "Surlyn® 9945" available from Du Pont Kabushiki Kaisha), 10 parts by weight of a styrene block-containing thermoplastic elastomer (trade name "Rabalon® SR04", available from Mitsubishi Chemical Corporation) and 3 parts by weight of titanium dioxide were kneaded in a twin screw kneading extruder to obtain a resin composition. The aforementioned core was placed into a final mold having numerous pimples on the inside face, followed by injection of the aforementioned resin composition around the core by injection molding to form a cover having a thickness of 1.9 mm. Numerous dimples having a shape inverted from the shape of the pimple were formed on the cover. The cover had a white color. The surface of this cover was subjected to a polishing process.

A clear paint including a two-component cured polyurethane as a base was prepared. The base material of this paint was a mixture of polyether polyol and polyester polyol. This base material had a hydroxyl value of 82 mg KOH/g. The curing agent of this paint was hexamethylene diisocyanate. This paint had a NCO:OH equivalence ratio of 1.2:1.0. This paint included composite particles (trade name "Xirallic® T60-20 WNT Sunbeam Gold", available from Merck & Co., Inc.) having the nucleus constituted with aluminum oxide, and the coat layer constituted with titanium oxide. The amount of the composite particles was 10 parts by weight per 100 parts by weight of the base resin. The composite particles are flaky, and had a particle size of 20 μm. The paint was applied on the cover with a spray gun. The paint was dried at a temperature of 40° C. for 120 min to give a paint layer having a thickness of about 10 μm. Thus, a golf ball of Example 1 having a diameter of 42.7 mm and a weight of about 45.4 g was obtained.

Examples 2 to 5

Golf balls of Examples 2 to 5 were obtained in a similar manner to Example 1 except that the amount of the composite particles in the paint layer was as shown in Table 1 below.

Comparative Example 1

A golf ball of Comparative Example 1 was obtained in a similar manner to Example 1 except that the composite particles were not blended in the paint layer.

Example 6 and Comparative Examples 2 to 5

Golf balls of Example 6 and Comparative Examples 2 to 5 were obtained in a similar manner to Example 1 except that the composite particles presented in Table 1 below were blended in the paint layer. Details of respective composite particles are as in the following.

T60-20

Merck & Co., Inc., trade name "Xirallic® T60-20 WNT Sunbeam Gold"

nucleus: aluminum oxide, coat layer: titanium oxide, particle size: 20 μm, flaky

T60-25

Merck & Co., Inc., trade name "Xirallic® T60-25 WNT Cosmic Turquoise"

nucleus: aluminum oxide, coat layer: titanium oxide, particle size: 20 μm, flaky Iriodin 201

Merck & Co., Inc., trade name "Iriodin 201"

nucleus: mica, coat layer: titanium oxide, particle size: 15 μm, flaky

HC Jade

Wacker Chemie GmbH, trade name "Helicone HC Jade"

liquid crystal polymer, particle size: 30 μm

MC1080RG

Nippon Sheet Glass Co., Ltd., trade name "Metashine MC1080RG"

nucleus: glass flake, coat layer: titanium oxide, particle size: 80 μm

PM2010

ECKART LLC, trade name "ALOXAL PM2010"

aluminum flake, particle size: 20 μm

Example 7

A golf ball of Example 7 was obtained in a similar manner to Example 1 except that: the amount of titanium dioxide in the cover was 0.2 parts by weight; 3 parts by weight of composite particles ("Xirallic® T60-20 WNT Sunbeam Gold", supra) were blended in the cover; and the composite particles were not blended in the paint layer.

Examples 8 to 11

Golf balls of Examples 8 to 11 were obtained in a similar manner to Example 7 except that the amount of the composite particles in the cover was as shown in Table 2 below.

Example 12 and Comparative Examples 6 to 9

Golf balls of Example 12 and Comparative Examples 6 to 9 were obtained in a similar manner to Example 7 except that the composite particles presented in Table 2 below were blended in the cover.

Example 13

A golf ball of Example 13 was obtained in a similar manner to Example 7 except that 10 parts by weight of composite particles ("Xirallic® T60-20 WNT Sunbeam Gold", supra) were blended in the paint layer.

Distinguishability

The golf balls of Examples 1 to 13 and Comparative Examples 2 to 9 were placed on grass, respectively, together with the golf ball of Comparative Example 1. Ten golf players visually observed the balls from a point 5 m away, and evaluated whether or not the ball of the present invention could be distinguished from the ball of Comparative Example 1. Based on the number of the golf player(s) who could distinguish the two balls, the following grading was made:

A: nine or more;
B: seven to eight;
C: four to six; and
D: three or less.

The results are shown in Tables 1 and 2 below.

High-Grade Looking

The appearance of each golf ball was evaluated by ten golf players. Based on the number of the golf player(s) who evaluated the ball exhibits high-grade looking, the following grading was made:

A: nine or more;
B: seven to eight;
C: four to six; and
D: three or less.

The results are shown in Tables 1 and 2 below.

Weather Resistance

Indices L*, a* and b* of each golf ball in the CIELAB space were determined with a color difference meter (Minolta Co., Ltd., "CR-221"). The indices L*, a* and b* are calculated according to the following formulae:

$$L^*=116(Y/Yn)^{1/3}-16;$$

$$a^*=500((X/Xn)^{1/3}-(Y/Yn)^{1/3}); \text{ and}$$

$$b^*=200((Y/Yn)^{1/3}-(Z/Zn)^{1/3}).$$

In these formulae, X, Y and Z represent tristimulus values XYZ, while Xn, Yn and Zn represent tristimulus values XYZ of a perfect reflecting diffuser. The CIELAB space conforms to a standard defined by Commission Internationale de l'Echairage (CIE) in 1976. In Japan, the CIELAB space is employed in "JIS Z 8729". L* is an index of lightness. The a* and b* are indices that correlate with hue and chroma saturation. The increasing negative values of a* indicate green direction, while the increasing positive values thereof indicate red direction. The increasing negative values of b* indicate blue direction, while the increasing positive values thereof indicate yellow direction. The golf ball was placed into a sunshine weather meter, and light rays were irradiated on this golf ball for 120 hours. Then, the indices L*, a* and b* were measured. □E was calculated according to the following formula:

$$\square E=((\square L^*)^2+(\square a^*)^2+(\square b^*)^2)^{1/2}.$$

The results are shown in the following Tables 1 and 2.

Durability of Paint Layer

A driver was attached to a swing machine (True Temper Co.). Each golf ball was hit 150 times under the condition to provide a head speed of 45 msec. Accordingly, the golf ball was observed, and the following grading was made based on the rate of peel area of the paint layer:

A: 0%;
B: 1% or greater and less than 5%;
C: 5% or greater and less than 25%; and
D: 25% or greater.

The results are shown in the following Tables 1 and 2.

Table 1

TABLE 1

| | | Evaluation Results | | | | | | | | | | |
|---|---|---|---|---|---|---|---|---|---|---|---|---|
| | | Comp. Example 1 | Example 2 | Example 3 | Example 1 | Example 4 | Example 5 | Example 6 | Comp. Example 2 | Comp. Example 3 | Comp. Example 4 | Comp. Example 5 |
| Cover | Surlyn 8945 | 45 | 45 | 45 | 45 | 45 | 45 | 45 | 45 | 45 | 45 | 45 |
| | Surlyn 9945 | 45 | 45 | 45 | 45 | 45 | 45 | 45 | 45 | 45 | 45 | 45 |
| | Rabalon SR04 | 10 | 10 | 10 | 10 | 10 | 10 | 10 | 10 | 10 | 10 | 10 |
| | titanium dioxide | 3 | 3 | 3 | 3 | 3 | 3 | 3 | 3 | 3 | 3 | 3 |
| Paint layer | base resin | 100 | 100 | 100 | 100 | 100 | 100 | 100 | 100 | 100 | 100 | 100 |
| | T60-20 | — | 0.5 | 3 | 10 | 20 | 33 | — | — | — | — | — |
| | T60-25 | — | — | — | — | — | — | 10 | — | — | — | — |
| | Iriodin 201 | — | — | — | — | — | — | — | 10 | — | — | — |
| | HC Jade | — | — | — | — | — | — | — | — | 10 | — | — |
| | MC1080RG | — | — | — | — | — | — | — | — | — | 10 | — |
| | PM2010 | — | — | — | — | — | — | — | — | — | — | 10 |
| Distinguishability | | — | B | A | A | A | A | A | B | B | B | B |
| Hgh-grade looking | | D | B | A | A | A | B | A | C | B | C | D |
| Weather resistance | | 2.4 | 2.4 | 2.4 | 2.5 | 2.5 | 2.5 | 2.5 | 2.6 | 8.4 | 2.8 | 2.7 |
| Durability of paint layer | | A | A | A | A | A | B | A | A | A | C | A |

Table 2

TABLE 2

| | | Evaluation Results | | | | | | | | | | |
|---|---|---|---|---|---|---|---|---|---|---|---|---|
| | | Example 8 | Example 9 | Example 7 | Example 10 | Example 11 | Example 12 | Comp. Example 6 | Comp. Example 7 | Comp. Example 8 | Comp. Example 9 | Example 13 |
| Cover | Surlyn 8945 | 45 | 45 | 45 | 45 | 45 | 45 | 45 | 45 | 45 | 45 | 45 |
| | Surlyn 9945 | 45 | 45 | 45 | 45 | 45 | 45 | 45 | 45 | 45 | 45 | 45 |
| | Rabalon SR04 | 10 | 10 | 10 | 10 | 10 | 10 | 10 | 10 | 10 | 10 | 10 |
| | titanium dioxide | 0.2 | 0.2 | 0.2 | 0.2 | 0.2 | 0.2 | 0.2 | 0.2 | 0.2 | 0.2 | 0.2 |
| | T60-20 | 0.05 | 0.3 | 3 | 10 | 17 | — | — | — | — | — | 3 |
| | T60-25 | — | — | — | — | — | 3 | — | — | — | — | — |
| | Iriodin 201 | — | — | — | — | — | — | 3 | — | — | — | — |
| | HC Jade | — | — | — | — | — | — | — | 3 | — | — | — |

TABLE 2-continued

| Evaluation Results | | | | | | | | | | | | |
|---|---|---|---|---|---|---|---|---|---|---|---|---|
| | | Example 8 | Example 9 | Example 7 | Example 10 | Example 11 | Example 12 | Comp. Example 6 | Comp. Example 7 | Comp. Example 8 | Comp. Example 9 | Example 13 |
| | MC1080RG | — | — | — | — | — | — | — | — | 3 | — | — |
| | PM2010 | — | — | — | — | — | — | — | — | — | 3 | — |
| Paint layer | base resin | 100 | 100 | 100 | 100 | 100 | 100 | 100 | 100 | 100 | 100 | 100 |
| | T60-20 | — | — | — | — | — | — | — | — | — | — | 10 |
| Distinguishability | | B | A | A | A | A | A | B | B | B | B | A |
| Hgh-grade looking | | B | A | A | A | B | A | C | B | C | C | A |
| Weather resistance | | 2.6 | 2.6 | 2.6 | 2.6 | 2.6 | 2.7 | 2.7 | 9.0 | 2.8 | 2.7 | 2.6 |
| Durability of paint layer | | A | A | A | A | A | A | A | A | A | A | A |

As shown in Tables 1 and 2, the golf balls of Examples are excellent in all evaluation items. Therefore, advantages of the present invention are clearly suggested by these results of evaluation.

The present invention can be applied to golf balls having a variety of structures, and one example is demonstrated herein.

The foregoing description is just for illustrative examples, therefore, various modifications can be made in the scope without departing from the principles of the present invention.

What is claimed is:

1. A golf ball which comprises a core, a cover provided to cover the core, and a paint layer provided to cover the cover, wherein the paint layer consists essentially of a base resin and composite particles, the composite particles having a nucleus, and a coat layer provided to coat the nucleus, and the nucleus is constituted with aluminum oxide, and the coat layer comprises titanium oxide.

2. The golf ball according to claim 1 wherein the composite particles are flaky.

3. The golf ball according to claim 1 wherein the paint layer is constituted with a resin composition, and 1 part by weight or more and 30 parts by weight or less composite particles are included per 100 parts by weight of a base resin of the resin composition.

* * * * *